US006414286B2

(12) United States Patent
Rock et al.

(10) Patent No.: US 6,414,286 B2
(45) Date of Patent: Jul. 2, 2002

(54) ELECTRIC HEATING/WARMING FIBROUS ARTICLES

(75) Inventors: Moshe Rock, Andover; Vikram Sharma, Stoneham, both of MA (US)

(73) Assignee: Malden Mills Industries, Inc., Lawrence, MA (US)

( * ) Notice: Subject to any disclaimer, the term of this patent is extended or adjusted under 35 U.S.C. 154(b) by 0 days.

(21) Appl. No.: 09/791,237

(22) Filed: Feb. 23, 2001

Related U.S. Application Data

(60) Continuation-in-part of application No. 09/697,100, filed on Oct. 26, 2000, which is a continuation-in-part of application No. 09/395,326, filed on Sep. 13, 1999, now Pat. No. 6,160,246, which is a division of application No. 09/296,375, filed on Apr. 22, 1999, now abandoned, application No. 09/791,237, which is a continuation-in-part of application No. 09/592,235, filed on Jun. 12, 2000, and a continuation-in-part of application No. 09/703,089, filed on Oct. 31, 2000, which is a division of application No. 09/468,627, filed on Dec. 21, 1999, now Pat. No. 6,215,111.

(51) Int. Cl.[7] ..... H05B 3/34

(52) U.S. Cl. ..... 219/545; 219/211; 219/212; 219/529; 219/549

(58) Field of Search ..... 219/545, 211, 219/212, 213, 217, 527, 528, 529, 542, 543, 549; 66/170, 171, 190, 191, 192, 194, 195; 428/89

(56) References Cited

U.S. PATENT DOCUMENTS

| | | | |
|---|---|---|---|
| 975,359 | A | 11/1910 | Hefter |
| 1,553,461 | A | 9/1925 | Negromanti |
| 1,744,327 | A | 1/1930 | Moore |
| 1,965,542 | A | 7/1934 | Colvin, Jr. |
| 2,025,586 | A | 12/1935 | Hall |
| 2,203,918 | A | 6/1940 | Moberg |
| 2,381,218 | A | 8/1945 | Jacob |
| 2,392,470 | A | 1/1946 | Fitzmaurice |
| 2,432,785 | A | 12/1947 | Moberg |
| 2,458,801 | A | 1/1949 | Schwartz |
| 2,581,212 | A | 1/1952 | Spooner, Jr. |
| 2,670,620 | A | 3/1954 | Goldstaub |
| 2,862,097 | A | 11/1958 | Negromanti |
| 2,945,115 | A | 7/1960 | Weitzel |
| 3,425,020 | A | 1/1969 | Toyooka et al. |
| 3,478,422 | A | 11/1969 | Inui |
| 3,513,297 | A | 5/1970 | Jordan |
| 3,528,874 | A | 9/1970 | Spencer |
| 3,721,799 | A | 3/1973 | Carlstrom |
| 3,859,506 | A | 1/1975 | Weckstein |

(List continued on next page.)

*Primary Examiner*—Teresa Walberg
*Assistant Examiner*—Fadi H. Dahbour
(74) *Attorney, Agent, or Firm*—Fish & Richardson P.C.

(57) ABSTRACT

A fibrous article that generates heat upon application of electrical power is formed, for example, by joining stitch and loop yarns to form a fibrous prebody, with the loop yarn overlaying the stitch yarn at a technical face and forming loops at a technical back of the fabric prebody. An electrical resistance heating element, e.g., in the form of conductive elements, is joined with the stitch and loop yarns in the prebody at symmetrical and/or asymmetrical spaced-apart intervals as the stitch yarn, the electrical resistance heating elements extending between opposite edge regions of the fibrous article and conductor elements, e.g. located along edge regions, connect the electrical resistance heating elements to a source of electrical power. The technical face and/or the technical back of the fabric body may have fleece formed by finishing non-conductive fibers of the stitch yarn and/or loop yarn in a manner to avoid damage to electrical conductance of the electrical resistance heating elements. Preferably, the conductive elements have the form of a conductive yarn with one or more of: a core of insulating material, an electrical resistance-heating element, e.g., about the core, and a sheath material surrounding the electrical resistance-heating element (and core).

86 Claims, 9 Drawing Sheets

U.S. PATENT DOCUMENTS 4,021,640 A 5/1977 Gross et al.
4,063,069 A 12/1977 Perri
4,245,149 A 1/1981 Fairlie
4,250,397 A 2/1981 Gray et al.
4,375,009 A 2/1983 Fearnside et al.
4,398,462 A 8/1983 Okano
4,459,461 A 7/1984 Spencer
4,481,881 A 11/1984 Okano
4,523,086 A 6/1985 Eilentropp
4,533,821 A 8/1985 Sato
4,564,745 A 1/1986 Deschenes
4,577,094 A 3/1986 Mills
4,607,154 A 8/1986 Mills
4,656,334 A 4/1987 Endo et al.
4,713,531 A 12/1987 Fennekels et al.
4,736,088 A 4/1988 Bart
4,792,662 A 12/1988 Kitagaki et al.
4,983,814 A 1/1991 Ohgushi et al.
5,073,688 A 12/1991 McCormack
5,081,341 A 1/1992 Rowe
5,298,722 A 3/1994 Tanaka
5,319,950 A 6/1994 Whitt et al.
5,321,960 A 6/1994 Whitt et al.
5,364,678 A 11/1994 Lumb et al.
5,412,181 A 5/1995 Giamati
5,422,462 A 6/1995 Kishimoto
5,484,983 A 1/1996 Roell
5,573,687 A 11/1996 Tanaka
5,582,757 A 12/1996 Kio et al.
5,679,277 A 10/1997 Niibe et al.
5,918,319 A 7/1999 Baxter
5,977,517 A 11/1999 Grosjean

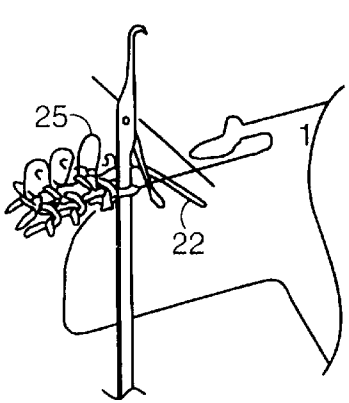
FIG. 5
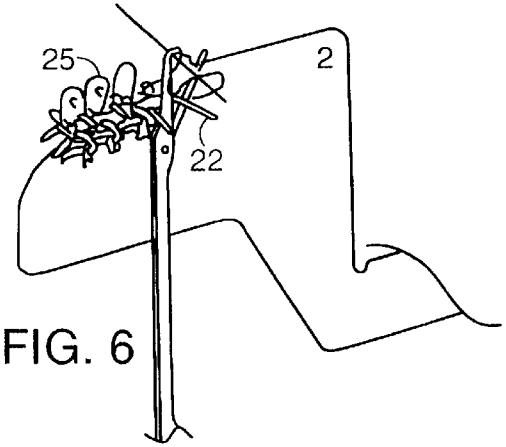
FIG. 6
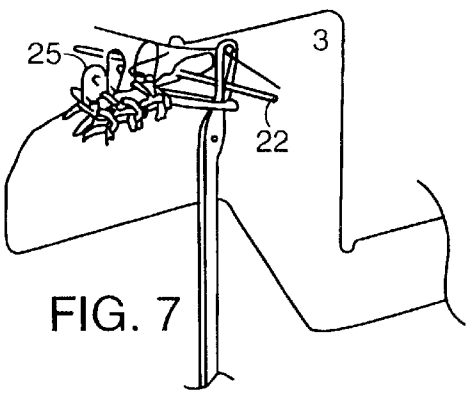
FIG. 7
FIG. 8
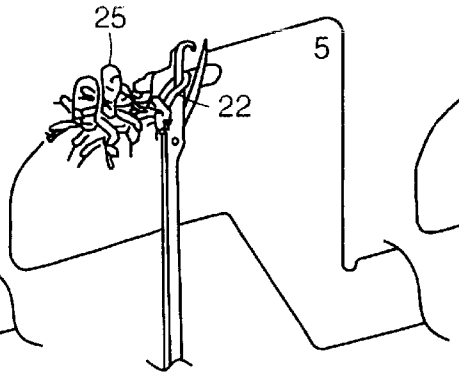
FIG. 9
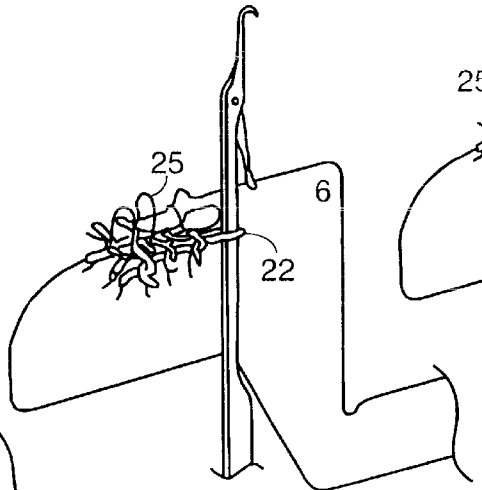
FIG. 10
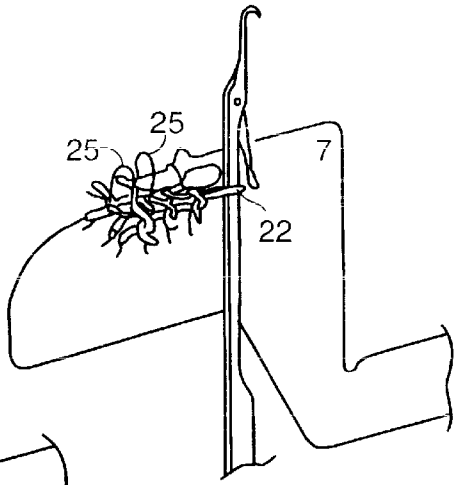
FIG. 11

ELECTRIC HEATING/WARMING FIBROUS ARTICLES

This application is a continuation-in-part of U.S. application Ser. No. 09/697,100, filed Oct. 26, 2000, which is a continuation-in-part of U.S. application Ser. No. 09/395,326, filed Sep. 13, 1999, now U.S. Pat. No. 6,160,246, issued Dec. 12, 2000, which is a division of U.S. application Ser. No. 09/296,375, filed Apr. 22, 1999, now abandoned; a continuation-in-part of U.S. application Ser. No. 09/592,235, filed Jun. 12, 2000, and a continuation-in-part of U.S. application Ser. No. 09/703,089, filed Oct. 31, 2000, which is a division of U.S. application Ser. No. 09/468,627, filed Dec. 21, 1999, now U.S. Pat. No. 6,215,111, the complete disclosures of all of which are incorporated herein by reference.

TECHNICAL FIELD

The invention relates to fabric articles that generate heat/warmth upon application of electricity.

BACKGROUND

Fabric or fibrous heating/warming articles are known, e.g., in the form of electric blankets, heating and warming pads and mats, heated garments, and the like. Typically, these heating/warming articles consist of a body defining one or a series of envelopes or tubular passageways into which electrical resistance heating wires or elements have been inserted. In some instances, the electric resistance heating wires are integrally incorporated into the body during its formation, e.g. by weaving or knitting. Relatively flexible electric resistance heating wires or elements, e.g., in the form of a core of insulating material, e.g., yarn, about which is disposed an electrical conductive element, e.g., a helically wrapped metal wire or an extruded sheath of one or more layers of conductive plastic, have been fabricated directly into the woven or knitted structure of a fabric body.

SUMMARY

According to one aspect of the invention, a fibrous article adapted to generate heat upon application of electrical power comprises a fibrous body comprised of non-conductive fibers, a plurality of spaced apart electrical resistance heating elements in the form of conductive elements joined in the fibrous body with the non-conductive fibers and extending generally between opposite edge regions of the fibrous body, and electrical conductor elements extending generally along the opposite edge regions of the fibrous body and adapted to connect the plurality of spaced apart electrical resistance heating elements in a parallel electrical circuit to a source of electrical power, the fibrous body having a technical face and a technical back, with fleece on at least one of the technical face and the technical back formed by finishing non-conductive fibers of at least one of the technical face and technical back in a manner to avoid damage to electrical conductivity performance of the conductive elements joined with the non-conductive fibers in the fibrous body.

Preferred embodiments of this aspect of the invention may include one or more of the following additional features. The electrical conductor elements are adapted for connecting the plurality of spaced-apart electrical resistance heating elements in the parallel electrical circuit to a power source of alternating current, or to a power source of direct current, e.g., a battery, which may be mounted to the fibrous body. Series of at least three electrical resistance-heating elements are symmetrically spaced and/or series of at least three electrical resistance-heating elements are asymmetrically spaced. The fibrous body comprises a body that may be formed, e.g., by knitting, e.g., to form a reverse plaited circular knitted body or a double knit body consisting of two, separate fibrous sheets joined by interconnecting fibrous elements; by weaving; by tufting or needling; by felting; or by laying up fibers to form a non-woven fibrous web. The fibrous body may comprise hydrophilic material and/or hydrophobic material. In terry knit products, the technical face is formed of a stitch yarn and the technical back is formed of a loop yarn; preferably, the loop yam forms loops that overlay the stitch yarn at the technical face and forms loops at the technical back. The fibrous body may have loops formed only in a center region. The fibrous body has fleece formed in non-conductive fibers upon both the technical back and technical face. The conductive elements have the form of a conductive yarn, e.g., a stitch yarn. The electrical conductor elements, at least in part, are applied as a conductive paste or as a conductive hot melt adhesive. The electrical conductor elements comprise a conductive wire. The conductive elements comprise one or more of: a core of insulating material, an electrical resistance heating filament, e.g., disposed generally about the core, and a sheath material generally surrounding the electrical resistance heating filament (and the core). The core comprises synthetic material, e.g., polyester. The electrical resistance-heating filament comprises at least one metal filament, and preferably at least three metal filaments, wrapped helically about the core. The metal filaments of the electrical resistance-heating element are formed of stainless steel. The electrical resistance-heating element has electrical resistance in the range of about 0.1 ohm/cm to about 500 ohm/cm. The sheath material comprises yarn wrapped about the electrical resistance-heating filament (and the core). The sheath material comprises synthetic material, e.g., polyester.

According to another aspect of the invention, a fibrous article adapted to generate heat upon application of electrical power comprises a fibrous body comprised of non-conductive fibers, a plurality of spaced apart electrical resistance heating/warming elements in the form of conductive elements joined in the fibrous body together with the non-conductive fibers and extending generally between opposite edge regions of the fibrous body, and electrical conductor elements extending generally along the opposite edge regions of the fibrous body and adapted to connect the plurality of spaced apart electrical resistance heating/warming elements in a parallel electrical circuit to a source of electrical power, the fibrous body having a face and a back, with fleece on at least one of the face and the back formed by finishing non-conductive fibers of at least one of the face and back in manner to avoid damage to electrical conductivity performance of the conductive elements joined with the non-conductive fibers in the fibrous body, and the fibrous body comprising a first fibrous layer and a second fibrous layer, and the plurality of spaced apart electrical resistance heating/warming elements of the fibrous body being disposed generally between the first fibrous layer and the second fibrous layer.

Preferred embodiments of this aspect of the invention may include one or more of the following additional features. The fibrous body comprises a double knit fibrous body and the first fibrous layer and the second fibrous layer are joined, in face-to-face relationship, by interconnecting fibrous elements, the plurality of spaced apart electrical resistance heating/warming elements of the fibrous body being positioned and spaced apart by the interconnecting fibers and joined by the conductors in a parallel circuit. The first fibrous layer and the second fibrous layer may be formed separately and joined in face-to-face relationship, with the plurality of spaced apart electrical resistance heating/warming elements of the fibrous body disposed therebetween; or the plurality of spaced apart electrical resistance heating/warming elements may be mounted upon a substrate, the substrate with the plurality of spaced apart electrical resistance heating/warming elements mounted thereupon being disposed between the first fibrous layer and the second fibrous layer; or the plurality of spaced apart electrical resistance heating/warming elements may be mounted upon at least one opposed surface of the first fibrous layer and the second fibrous layer. The first fibrous layer and second fibrous layer may be joined by laminating or by stitching. The substrate may comprise an open grid or a moisture-resistant, vapor permeable barrier material.

According to still another aspect of the invention, a fibrous article adapted to generate heat upon application of electrical power is formed by a method comprising the steps of: joining a stitch yarn and a loop yarn to form a fibrous prebody, with the loop yarn overlaying the stitch yarn at a technical face and forming in loops at a technical back of the fibrous prebody; at spaced-apart intervals, incorporating into the fibrous prebody as the stitch yarn an electrical resistance heating/warming element in the form of a conductive yarn; forming the fibrous prebody into a fibrous body, with the electrical resistance heating/warming elements extending between opposite edge regions of the fibrous body; in a manner to avoid damage to electrical conductivity performance of the electrical resistance heating/warming elements, finishing non-conductive fibers of at least one of the technical face and the technical back of the fibrous body to form a fleece surface region; and providing conductive elements for connecting the electrical resistance heating/warming elements, in parallel, to a source of electrical power.

Preferred embodiments of this aspect of the invention may include one or more of the following additional features. The method further comprises the step of joining the stitch yarn and the loop yarn by a reverse plaiting circular knitting process. The method further comprises the steps of: in a manner to avoid damage to electrical conductivity performance of the electrical resistance heating/warming elements, finishing non-conductive fibers of the technical face of the fibrous body to form a first fleece surface region; and in a manner to avoid damage to electrical conductivity performance of the electrical resistance heating/warming elements, finishing non-conductive fibers of the technical back of the fibrous body to form a second fleece surface region.

According to another aspect of the invention, a method of forming a fibrous article adapted to generate heat upon application of electrical power comprises the steps of: joining a stitch yarn and a loop yarn to form a fibrous prebody, the stitch yarn forming a technical face of the fibrous prebody and the loop yarn forming a technical back of the fibrous prebody, the loop yarn forming in loops that overlay the stitch yarn at the technical face and at the technical back of the fibrous prebody; at spaced-apart intervals, incorporating into the fibrous prebody as the stitch yarn an electrical resistance heating element in the form of a conductive yarn; forming the fibrous prebody into a fibrous body, with the electrical resistance heating elements extending between opposite edge regions of the fibrous body; in a manner to avoid damage to electrical conductivity of the electrical resistance heating elements, finishing non-conductive fibers of at least one of the technical face and the technical back of the fibrous body to form a fleece surface region; and providing conductive elements for connecting the electrical resistance heating elements, in parallel, to a source of electrical power.

Preferred embodiments of this aspect of the invention may include one or more of the following additional features. The method further comprises the step of joining the stitch yam and the loop yarn by a reverse plaiting circular knitting process. The method further comprises the steps of: in a manner to avoid damage to electrical conductivity of the electrical resistance heating elements, finishing non-conductive fibers of the technical face of the fibrous body to form a first fleece surface region, and, in a manner to avoid damage to electrical conductivity of the electrical resistance heating elements, finishing non-conductive fibers of the technical back of the fibrous body to form a second fleece surface region. The conductive yarn of the fibrous prebody comprises one or more of: a core of insulating material, an electrical resistance heating filament, e.g., disposed generally about the core, and a sheath material generally surrounding the electrical resistance heating element (and the core). The method further comprises the step of forming the sheath material by wrapping the electrical resistance-heating element (and the core) with fibrous elements. The method further comprises the step of connecting the conductive element to a source of electric power and generating heat. The method further comprises the step of connecting the conductive element to a source of electric power comprising, e.g., alternating current or direct current, e.g., a battery, which may be mounted to the fibrous article, and generating heat. The method further comprises the steps of: limiting formation of loops to a central region of the fibrous prebody, the central region being spaced from edge regions in the fibrous body, and providing the conductive elements for connecting the electrical resistance heating elements to a source of electrical power in the edge regions of the fibrous body. The method further comprises the step of rendering elements of the fibrous body hydrophilic and/or rendering elements of the fibrous body hydrophobic.

An objective of the invention is to provide fibrous electric heating/warming articles, e.g. electric blankets, heating and warming pads, heated garments, etc., into which a plurality of spaced-apart electric resistance heating members, in the form of conductive elements, are joined with non-conductive fibers, e.g., by knitting, weaving, tufting or needling, felting, laying up of a non-woven web, or any other suitable process. The fibrous body of the heating/warming article is subsequently subjected to a finishing process, e.g., non-conductive fibers at one or both surfaces of the body may be napped, brushed, sanded, etc., in a manner to avoid damage to electrical conductance of the electric resistance heating elements, to form fleece. In a planar structure, such as an electric heating blanket, the electric resistance heating members are connected at their ends along opposite edge regions of the planar body, i.e. of the blanket, and may be powered by alternating current or direct current, including by one or more batteries mounted to the fibrous heating/warming article.

The details of one or more embodiments of the invention are set forth in the accompanying drawings and the description below. Other features, objects, and advantages of the invention will be apparent from the description and drawings, and from the claims.

DESCRIPTION OF DRAWINGS

FIGS. 5–11 are sequential views of a cylinder latch needle in a reverse plaiting circular knitting process, e.g. for use in forming an electric heating/warming composite fibrous article of the invention.

FIG. 12 is a somewhat diagrammatic end section view of a preferred embodiment of a conductive yarn for an electric heating/warming fibrous article of the invention, while

Like reference symbols in the various drawings indicate like elements.

DETAILED DESCRIPTION

Figure 1:
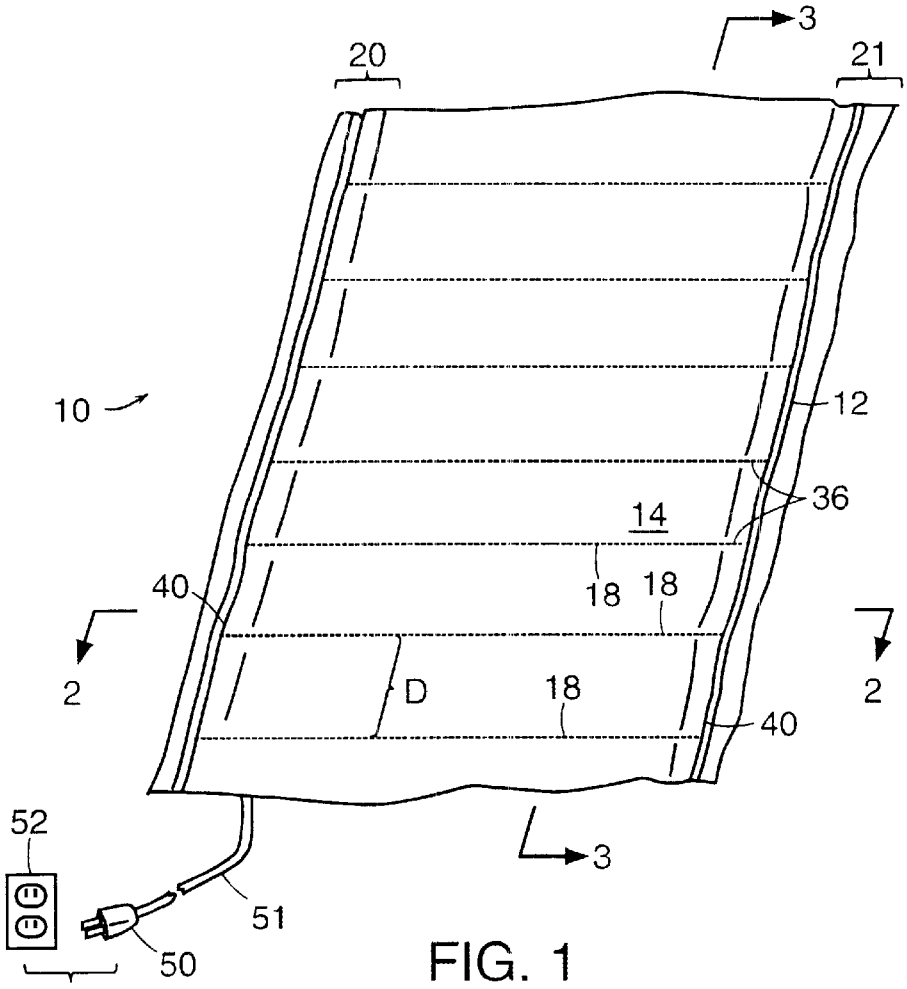
FIG. 1 is a perspective view of an electric heating/warming composite fibrous article of the invention in the form of an electric blanket.
Figure 2:
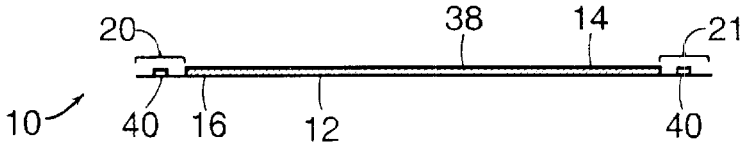
FIG. 2 is an end section view of the electric heating/warming composite fibrous article of the invention, taken at the line 2—2 of FIG. 1.
Figure 3:
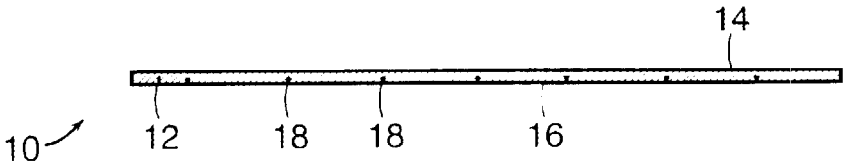
FIG. 3 is a side section view of the electric heating/warming composite fibrous article of the invention, taken at the line 3—3 of FIG. 1.
Figure 4:
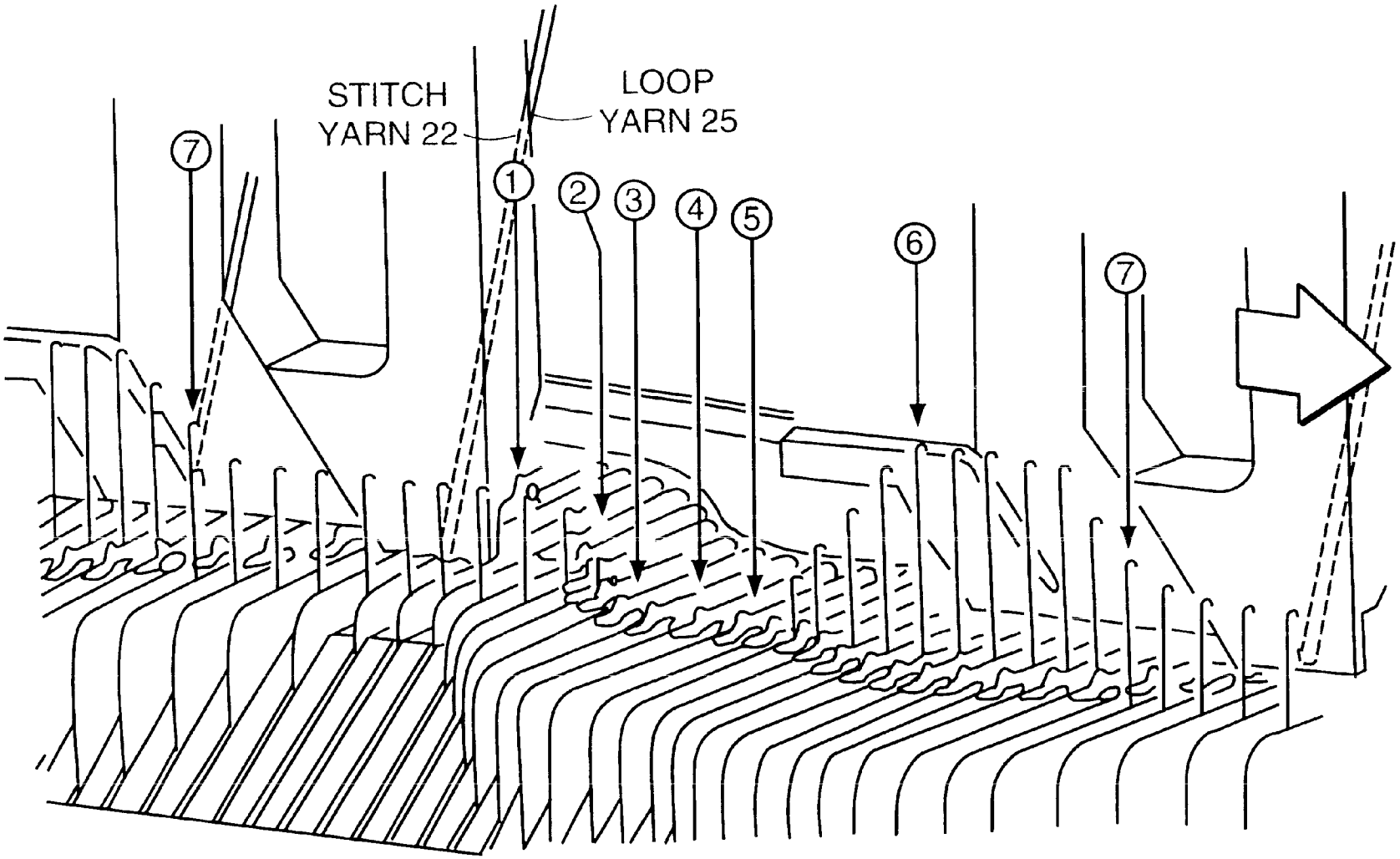
FIG. 4 is a perspective view of a segment of a circular knitting machine.

Referring to FIGS. 1–3, a fibrous electric heating/warming composite article 10 of the invention, e.g. an electric blanket, adapted to generate heat upon application of electrical power, consists of a fibrous body 12 having a technical back 14 and a technical face 16. The body 12 incorporates a plurality of spaced-apart electric resistance heating elements 18 extending between opposite edge regions 20, 21 of the body.

Referring also to FIGS. 4–11, in a preferred embodiment, the body 12 is formed by joining a stitch yarn 22 and a loop yarn 25 in a standard reverse plaiting circular knitting (terry knitting) process, e.g. as described in Knitting Technology, by David J. Spencer (Woodhead Publishing Limited, 2nd edition, 1996), the entire disclosure of which is incorporated herein by reference. Referring again to FIGS. 2 and 3, in the terry knitting process, the stitch yarn 22 forms the technical face 16 of the resulting fibrous fabric body and the loop yarn 25 forms the opposite technical back 14, where it is formed into loops (25, FIG. 10) extending over the stitch yarn 22. In the fibrous fabric body 12 formed by reverse plaiting circular knitting, the loop yarn 25 extends outwardly from the planes of both surfaces and, on the technical face 16, the loop yarn 25 covers the stitch yarn 22 (e.g., see FIG. 17). As a result, during napping of fibers at the opposite fabric surfaces to form a fleece, the loop yarn 25 protects the stitch yarn 22, including the conductive yarns 26 knitted into the fibrous fabric body in the stitch yarn position.

The loop yarn 25 forming the technical back 14 of the fibrous knit fabric body 12 can be made of any synthetic or natural material. The cross section and luster of the fibers or the filament may be varied, e.g., as dictated by requirements of the intended end use. The loop yarn can be a spun yarn made by any available spinning technique, or a filament yarn made by extrusion. The loop yarn denier is typically between 40 denier to 300 denier. A preferred loop yarn is a 200/100 denier T-653 Type flat polyester filament, e.g. as available commercially from E.I. duPont de Nemours and Company, Inc., of Wilmington, Del.

The stitch yarn 22 forming the technical face 16 of the fibrous knit fabric body 12 can be also made of any type of synthetic or natural material in a spun yarn or a filament yarn. The denier is typically between 50 denier to 150 denier. A preferred yarn is a 70/34-denier filament textured polyester, e.g. as available commercially from UNIFI, Inc., of Greensboro, N.C.

Figure 12:
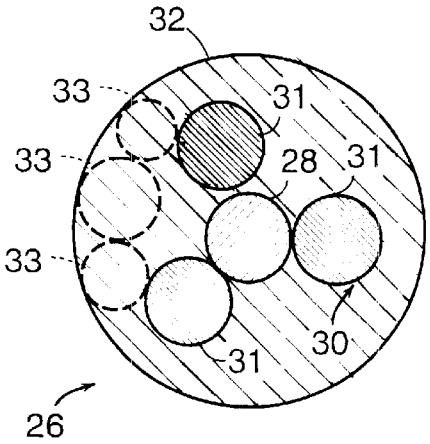

Referring now also to FIG. 12, and also to FIGS. 13–16, at predetermined, spaced, symmetrical or asymmetrical intervals during the knitting process, an electric resistance-heating member 18 in the form of a conductive yarn 26 is incorporated into the fabric body 12, e.g., in place of the stitch yarn 22. Referring to FIG. 12, in a preferred embodiment, the conductive yam 26 forming the electrical resistance heating elements 18 consists of a core 28 of insulating material, e.g. a polyester yarn, about which extends an electrical conductive element 30, e.g. three filaments 31 of stainless steel wire (e.g. 316L stainless steel) wrapped helically about the core 28, and an outer covering 32 of insulating material, e.g. polyester yarns 33 (only a few of which are suggested in the drawings) helically wrapped about the core 28 and the filaments 31 of the electrical conductive element 30. The conductive yarn 26 is available, e.g., from Bekaert Fibre Technologies, Bekaert Corporation, of Marietta, Ga., as yarn series VN14.

Figure 15:
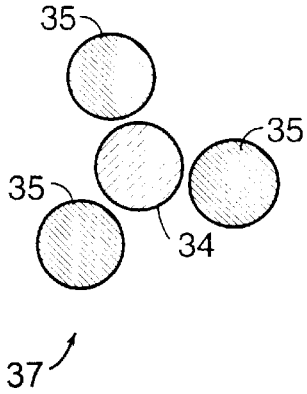
FIGS. 13–16 are similar views of alternative embodiments of conductive elements for fibrous electric heating/warming articles of the invention.
Figure 13:
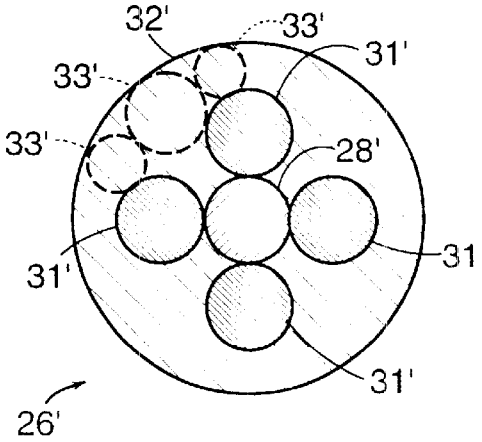
Figure 16:
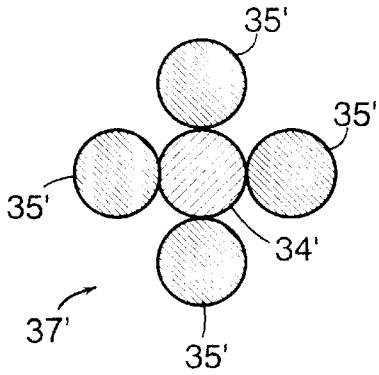
Figure 14:
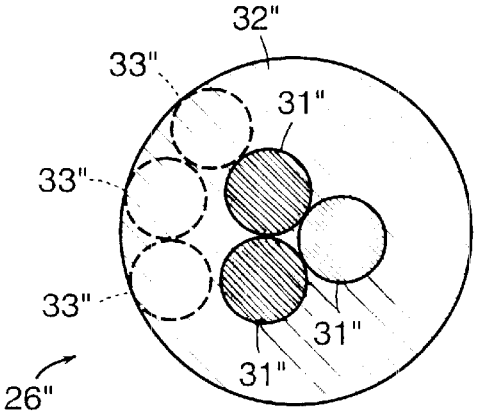

The number of conductive filaments in the conductive yarn, and the positioning of the conductive filaments within the conductive yarn, are dependent, e.g., on end use requirements. For example, in alternative configurations, in FIG. 13, a conductive yarn 26' has four filaments 31' wrapped about core 28' with an outer covering 32' of polyester yarns 33'; in FIG. 14, a conductive yarn 26" has three filaments 31" wrapped by outer covering 32" of polyester yarns 33", without a core. Referring to FIGS. 15 and 16, in other embodiments, conductive yarns 37, 37', respectively, are formed without an outer covering about the filaments 35, 35', respectively, wrapped about core 34, 34', respectively. Instead, the stitch yarn 22 and loop yarn 25 of the fabric body 12 serve to insulate the conductive yams in the fibrous heating/warming fabric article.

The resistivity of the conductive yarn can be selected in the range, e.g., of from about 0.1 ohm/cm to about 500 ohm/cm on the basis of end use requirements of the fibrous heating/warming fabric article 10. However, conductive yarns performing outside this range can also be employed, where required or desired. The core of the conductive yarn and the sheath material of the outer covering over the conductive filaments may be made of synthetic or natural material. The outer covering may also have the form of a sleeve, e.g. a dip-coated or extruded sleeve. Conductive yarns of different constructions suitable for use according to this invention can also be obtained from Bekaert Fibre Technologies.

As mentioned above, in a preferred method of the invention, the fibrous fabric body 12 is formed by reverse plaiting on a circular knitting machine. This is principally a terry knit, where the loops formed of the loop yarn 25 cover the stitch yarn 22 on the technical face 16 (see FIG. 17). The conductive yarn is incorporated into the fibrous knit fabric prebody formed on the circular knitting machine at a predetermined spacing or distance apart, D (FIG. 1), for uniform heating in the resulting heating/warming fabric article 10. In a fabric prebody of the invention, the spacing is typically a function, e.g., of the requirements of heating, energy consumption and heat distribution in the article to be formed. For example, the spacing of conductive yarns may be in the range of from about 0.02 inch to about 2.5 inches. However, other spacing may be employed, depending on the conditions of intended or expected use, including the resistivity of the conductive yarns. The conductive yams may be spaced symmetrically from each other, or the conductive yarns may be spaced asymmetrically, with varying spacing, as desired.

Also as mentioned above, a preferred position of the conductive yarn is in the stitch position of the circular knitted construction. Series of conductive yarns may then be knit symmetrically, i.e., at a predetermined distance apart, in each repeat, i.e., the conductive yarn can be in stitch position at any feed repeat of the circular knitting machine. Alternatively, or in addition, the feed position may be varied, and series of conductive yarns may be knit asymmetrically, with the yarns more closely or widely spaced, e.g., as desired or as appropriate to the intended product use. Again, the specific number of feeds, and the spacing of the conductive yams, is dependent on the end use requirements. Also, in a fibrous fabric body of the invention, the power consumption for each conductive yarn is generally considerably lower than in the separate heating wires of prior art devices. As a result, the conductive yarns in a fibrous fabric body of the invention can be placed relatively more closely together, with less susceptibility to hot spots.

Figure 17:
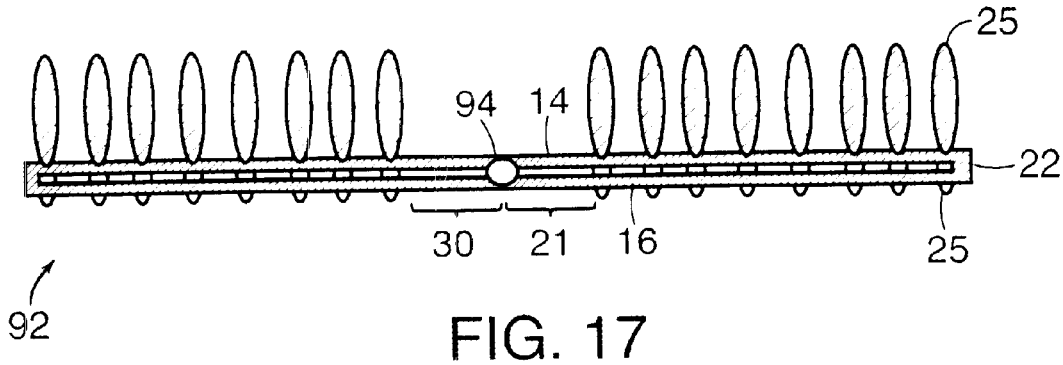
FIG. 17 is a somewhat diagrammatic section view of a segment of a tubular knit body during knitting.
Figure 18:
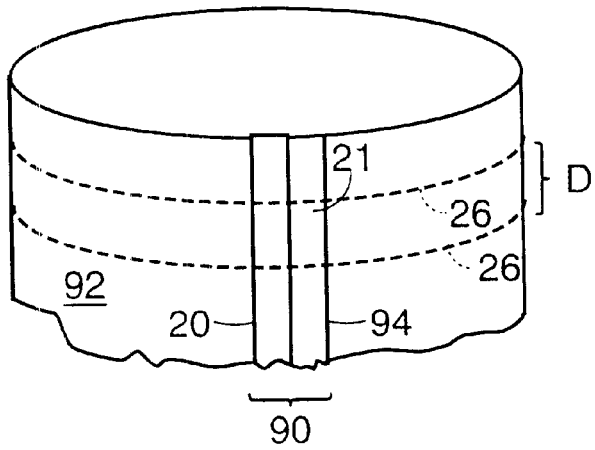
FIG. 18 is a somewhat diagrammatic perspective view of the tubular knit body of FIG. 17.

Referring to FIGS. 17 and 18, the edge regions 20, 21 may be formed as a panel 90 in the tubular knit body 92. The edge regions 20, 21 of the fibrous fabric body are preferably formed without loops, and in a manner such that the edge regions do not curl upon themselves, e.g. the edge region panel is formed by single lacoste or double lacoste knitting. The end portions 36 (FIG. 1) of the conductive yarns 26 extending into the flat, edge regions 20, 21 without loops are thus more easily accessible in the end regions for completing an electrical heating circuit, as described below.

The fibrous tubular knit body 92 is-removed from the knitting machine and slit, e.g., along a line of stitches in a "needle-out" region 94 marking the desired slit line, to create a planar fabric. Alternatively, for increased accuracy, the fibrous tubular knit body 92 may be slit on-line, e.g. by a cutting edge mounted to the knitting machine.

Preferably, the fibrous knitted fabric body 12 incorporating the electric resistance heating elements 18 in the form of the conductive yarns is next subjected to finishing. During the finishing process, the fibrous fabric body 12 may go through processes of sanding, brushing, napping, etc., to generate a fleece 38. The fleece 38 may be formed in non-conductive fibers on one face of the fibrous fabric body 12 (FIG. 2), e.g., on the technical back 14, in the loop yarn, or a fleece 38, 38' may be formed in non-conductive fibers on both faces of the fibrous fabric body 12' (FIG. 19), including on the technical face 16, in the overlaying loops of the loop yarn and/or in the stitch yarn. In either case, the process of generating the fleece on the face or faces of fabric body is preferably performed in a manner to avoid damage to the conductive yarn that is part of the construction of the fibrous fabric body 12. In particular, the fleece is formed in a manner that avoids damage to the conductive filaments of the conductive yarn that would result in an increase in resistance to the point of creating an undesirable local hot spot, or would sever the conductive yam completely, which could result in undesirable increased electrical flow elsewhere in the circuit. The fabric body may also be treated, e.g. chemically, to render the material hydrophobic or hydrophilic.

Figure 19:
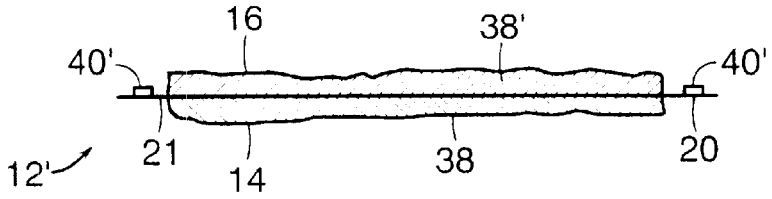
FIG. 19 is an end section view, similar to FIG. 2, of a fibrous electric heating/warming article of the invention with fleece on both faces.
Figure 20:
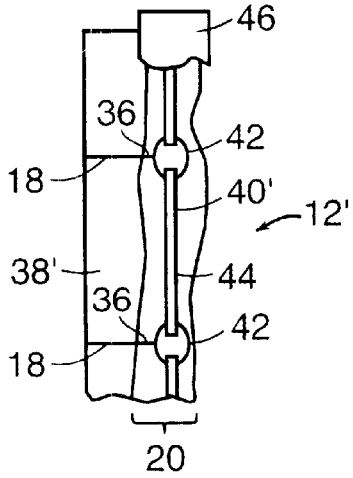
FIG. 20 is an enlarged, plan view of the technical face showing an alternative embodiment of a conductor element.

After finishing, and after the fibrous fabric body is heat set for width, conductive buses 40 are provided in opposite edge regions 20, 21 (where, preferably, there are no loops on the surface) to connect the spaced apart electrical resistance heating elements 18, in parallel, to a source of electrical power, thereby to complete the electrical circuit. The conductive buses 40 may be formed or attached upon the technical back 14, as shown in FIG. 1, or they may instead be formed or attached upon the technical face 16, as seen in FIGS. 19 and 20. Any suitable method may be used to complete the circuit. For example, referring to FIG. 1, the conductive bus 40 may, at least in part, be applied in the form of a conductive paste, e.g. such as available commercially from Loctite Corporation, of Rocky Hill, Conn. The conductive paste may be applied as a stripe to a surface of the fabric body 12 in electrical conductive relationship with the electrical resistance heating elements 18, and then connected to the power source. (If necessary, the conductive filaments of the electrical resistance heating elements 18 may be exposed, e.g., the polyester covering yarn may be removed with solvent or localized heat, e.g. by laser; the covering yarn may be manually unraveled; or the fabric body 12 may be formed with a needle out in the flat regions 20, 21, thus to facilitate accessibility to each of the conductive yarns.) More preferably, the conductive buses 40, in the form of conductive yarn or thread, are attached upon the surface of the fibrous fabric body 12, e.g., by stitching, e.g. embroidery stitching, sewing, or with an adhesive, such as by laminating. Alternatively, referring to FIG. 20, the conductive bus 40' may consist of localized dots or regions 42 of conductive paste applied in electrical contact with exposed conductive filaments of the electric resistance heating elements 18, with a conductive metal wire 44 disposed in electrical conductive contact with, and extending, preferably continuously, between, the localized conductive paste regions 42. The electric conductive bus 40' is thereafter covered by a layer of fabric material 46 joined to overlay a portion or substantially all of the surface of the fabric body 12', e.g., in the form of a cloth trim or edging material attached, e.g., by stitching along the edge of the fabric body 12', or in the form of a second layer of fabric joined to fabric body 12', e.g., by stitching or lamination.

The conductive bus 40 is preferably flexible, corrosion resistant, with low electrical resistivity, e.g. 0.1 ohm/meter to 100 ohm/meter, and mechanically durable. Other considerations include cost, availability in the market, and ease of fabrication.

The conductive bus 40 may thus: have the form of a wire, e.g., stranded, twisted, or braided; a conductive-coated textile, e.g., a coated filament or fabric, or a woven ribbon; a foil tape, e.g., adhesive backed, with or without a conductive backing; a conductive-filled resin, e.g., disposed in a continuous line; or a hybrid textile, e.g., including tinsel wire or stainless steel filaments, in twisted, braided, stranded, woven or knitted configuration. The conductive bus 40 may also have the form of a single yarn, or two or more parallel yarns, woven or knitted into or stitched upon the fabric body, or a tape or band of conductive material attached upon the surface of the fabric.

In a presently preferred form, the conductive bus 40 may be a narrow woven element, incorporating silver-coated copper tinsel wire, either multi-strand or individual strands in parallel, with periodic floats provided for contact with the conductive yarns, or a narrow woven element pre-coated with conductive thermoplastic in a stripe pattern, with discontinuous diagonal stripes to provide flexibility and ensure registration with conductive yarns. The conductive bus 40 may also extend in multiple elements extending generally parallel in the edge region of the fabric, with similar or different lengths, to connect to distinct sets of conductive yarns, in this manner reducing the level of electrical current carried by each conductive bus element in the region close to the source of electrical power. In the case of conductive buses of different lengths, the resistivity of the individual conductive bus elements may be different.

The conductive bus 40 is preferably mounted upon the surface of the fabric body in a manner to provide strain relief. For example, strain relief attachment may be provided by sewing the conductive bus to the fabric, by tacking the conductive bus to the fabric body with mechanical fasteners, such as snaps, grommets, staples, or rivets; by over-molding in place strain relief injection-molded "buttons"; or by incorporating strain relief and electrical connection rigid filled resin having low viscosity. The conductive yarns 18 and conductive bus 40 may be connected electrically by conductive welding or paste; rivets, snaps, or metal holders or fasteners; interlacing, knitting-or weaving in, or combinations of the above.

Figure 21:
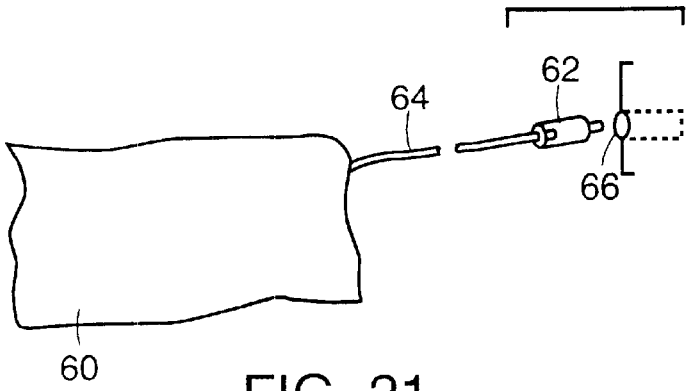
FIGS. 21, 22 and 23 are somewhat diagrammatic representations of other embodiments of fibrous heating/warming articles of the invention, as adapted to be powered by direct current, e.g., an automobile warming or heating pad (FIG. 21), adapted to be powered from an automobile battery; and a stadium or camping blanket (FIG. 22) and a garment (FIG. 23), adapted to be powered from a battery replaceably mounted to the article.
Figure 23:
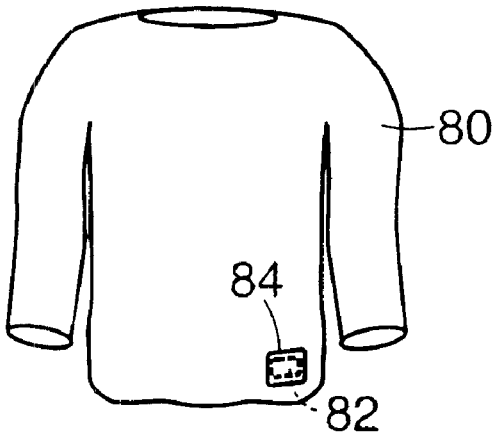
Figure 22:
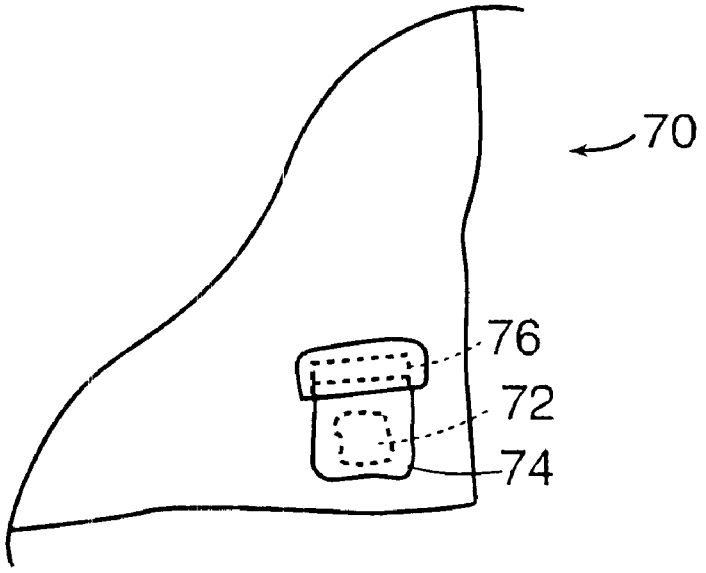

The completed circuit is next connected to a power source to supply electrical power to the electrical resistance heating elements for the required amount of heat generation. For example, referring to FIG. 1, a fibrous electric heating/warming fabric article 10 of the invention (an electric blanket) is adapted for connection to a source of alternating current by means of plug 50 on cord 51 for insertion in household outlet 52. Referring to FIG. 21, a fibrous warming or heating pad 60 of the invention, e.g. for an automobile seat, is adapted for connection to a source of direct current by means of plug 62 on cord 64 for insertion into the cigarette lighter or other power outlet 66 of an automobile. Referring to FIGS. 22 and 23, a fibrous stadium or camping blanket 70 and a fibrous garment 80 of the invention each includes a source of direct current, i.e. a battery pack 72, 82, respectively, e.g., as available from Polaroid Corporation, of Cambridge, Mass., replaceably mounted to the heating/warming fabric article, e.g. in a pocket 74, 84, respectively. Referring to FIG. 22, the pocket may be secured by a hook-and-loop type fastener 76. Preferably, for certification by Underwriters Laboratories Inc. (UL®), the voltage supplied by the power source to the electrical resistance heating elements is lower than 25 volts, e.g. a Class II UL® certified transformer may be used to step down a 110 v power supply to 25 volts or under.

Figure 29:
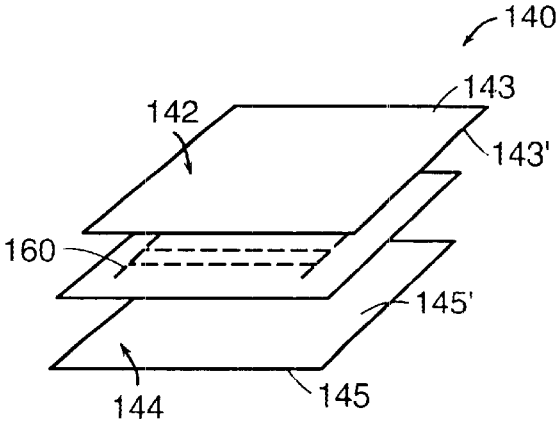
FIGS. 29 and 30 are somewhat diagrammatic perspective views of other embodiments of electric heating/warming articles of the invention formed of two or more layers.
Figure 30:
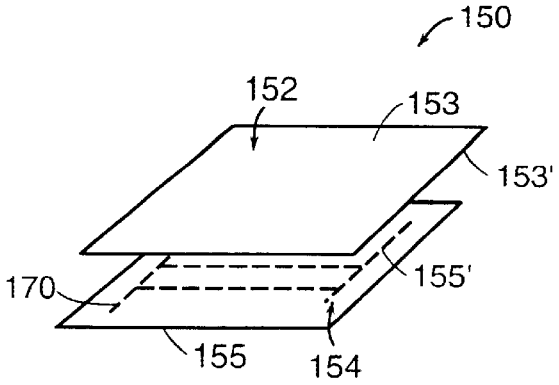

Referring to FIGS. 29 and 30, in preferred embodiments, fibrous, multi-layer heating/warming fabric articles 140, 150 consist of at least two layers of fibrous fabric 142, 144 and 152, 154, respectively. Preferably, these layers of fibrous fabric have outer surfaces 143, 145 and 153, 155, respectively, fibers of one or both of which may be raised or fleece, and smooth (non-fleece), opposed inner surfaces 143', 145' and 153', 155', respectively, with a heating/warming circuit of the invention (represented by dashed lines 160, 170, respectively) disposed therebetween. In one preferred embodiment (FIG. 29), the heating/warming circuit 160 is associated, e.g., incorporated in, mounted upon, or otherwise joined to, a separate fibrous heating/warming fabric article 162, with which it is laminated, or otherwise disposed and secured, e.g., by stitching, between the outer layers of fabric 142, 144. In this embodiment, the fibrous heating/warming fabric article 162 may be formed as described above, e.g. with respect to FIG. 1, with the heating /warming circuit of spaced apart (symmetrical or asymmetrical) electrical resistance heating elements, e.g., in the form of conductive yams, incorporated into the fibrous fabric article 162 and extending between conductive buses at opposite edge regions. Alternatively, the fibrous heating/warming fabric article 162 may be of the form described in our co-pending patent application U.S. Ser. No. 09/592,235, filed Jun. 12, 2000 and entitled "Electric Resistance Heating/Warming Articles," the entire disclosure of which is incorporated herein by reference, with the heating/warming circuit 160 formed of conductive yams disposed and secured upon the surface of the fibrous fabric article 162 and extending between conductive buses at opposite edge regions. For example, the conductive yarns may be fastened upon the surface, e.g., in embroidery stitches or sewing, by adhesive, or by mechanical locking.

In another embodiment (FIG. 30), the heating/warming circuit 170 may be incorporated into one layer (or both layers) of fibrous fabric 152, 154, or may be mounted upon an inner surface 153', 155' of one layer (or both layers) of fibrous fabric 152, 154, e.g., as described above with respect to FIG. 29.

The resulting product is a fibrous electric blanket, e.g., 90 inches by 90 inches with a 24-volt power supply, with features not available with blankets currently on the market. In a preferred embodiment, the fibrous blanket has the characteristics of being: flexible, foldable, portable, able to be washed frequently, comfortable, with zone heating and low voltage (for increased safety).

A number of embodiments of the invention have been described. Nevertheless, it will be understood that various modifications may be made without departing from the spirit and scope of the invention. For example, fibrous electric heating/warming articles of the invention may be formed by any suitable method that results in a fibrous body formed of non-conductive fibers and conductive elements capable of generating heating/warming when connected to a source of electrical power, the non-conductive fibers being exposed for finishing at one or both surfaces to create fleece, the finishing being performed in a manner to avoid damage to electrical conductivity performance of the conductive elements joined with the non-conductive fibers in the fibrous body. The fibrous body may be formed, e.g., by knitting, weaving, tufting or needling, felting, laying up or otherwise forming a non-woven web, or any other suitable process.

Figure 24:
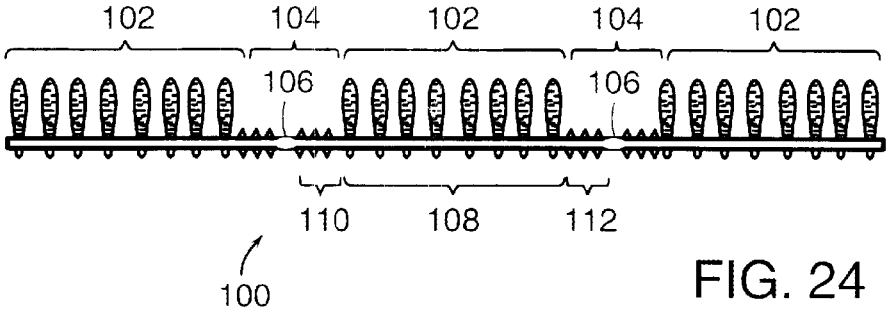
FIG. 24 is a somewhat diagrammatic sectional view of a segment of a tubular knit body knitted in a continuous web, to form multiple, alternating machine-direction panels or strips of regions with loops bounded by regions without loops.
Figure 25:
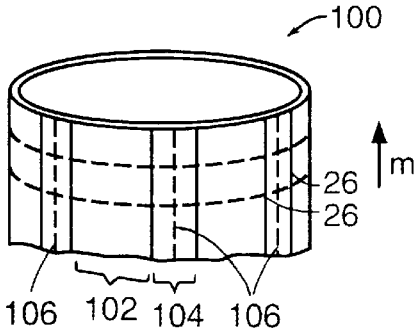
FIG. 25 is a somewhat diagrammatic perspective view of the tubular knit body of FIG. 24.

Also, referring to FIGS. 24 and 25, for manufacture of fibrous electric heating/warming fabric articles of narrow width, relative to the width of the knitted web, a tubular knit body 100 may be formed as a continuous web, e.g., during knitting, with multiple, alternating machine-direction (arrow, M) panels or strips of regions with loops 102 bounded along each edge by regions without loops 104. The fibrous tubular knit body 100 can removed from the knitting machine and slit, in the direction of the continuous web, along each region without loops 104, e.g. along lines of "needle-out" regions 106 marking desired slit lines, or the fibrous tubular knit body 100 can also be slit on-line, to create multiple panels of planar fabric, each panel having a central region 108 with loops bounded by opposite edge regions 110, 112 without loops. Each of the narrow panels of fibrous fabric can then be processed to form relatively narrow fibrous electric heating/warming fabric articles of the invention, e.g. personal heating pads or the like, e.g., by severing in a direction generally transverse to the continuous web direction.

Figure 26:
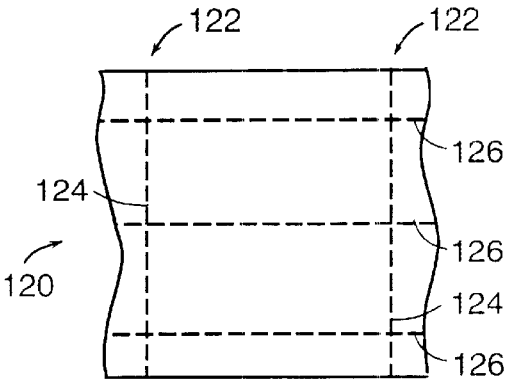
FIGS. 26 and 27 are somewhat diagrammatic plan views of segments of woven electric heating/warming articles of another embodiment of the invention.
Figure 27:
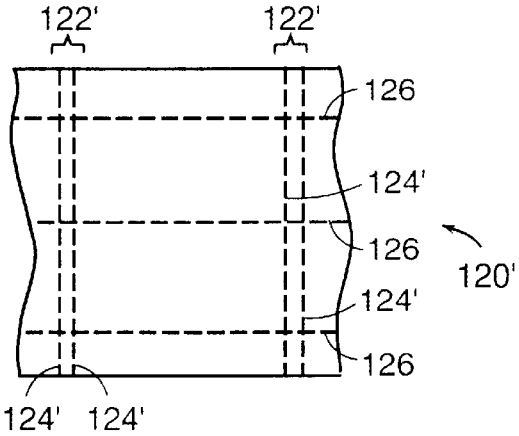

Also, other methods of constructing fibrous heating/warming fabric articles of the invention may be employed, e.g. the conductors may be incorporated by warp knit or weft knit construction or by woven construction. For example, referring to FIGS. 26 and 27, in fibrous woven electric heating/warming fabric articles 120, 120' of another embodiment of the invention, conductive bus 122, 122' may be in the position of a filling yarn or a warp yarn. The fibrous fabric body may be plush woven, i.e., formed as two sheets joined by interconnecting yarns or fibers. The sheets are then separated by cutting the interconnecting yarns, e.g., on-line, to provide two sheets, with the ends of the interconnecting yarns finished to provide each sheet with a plush surface. Alternatively, the fibrous fabric body may be flat woven of coarse yarn, which is then finished to form a raised (fleece) surface. The bus yarns may be comprised of one conductive yarn 124 (FIG. 26) with a resistivity of, e.g., 0.1 to 50 ohm per meter, or of multiple (i.e. two or more) conductive yarns 124' (FIG. 27), thus to ensure a more positive connection between the electric heating/warming elements 126 and the bus yarns 122.

Figure 28:
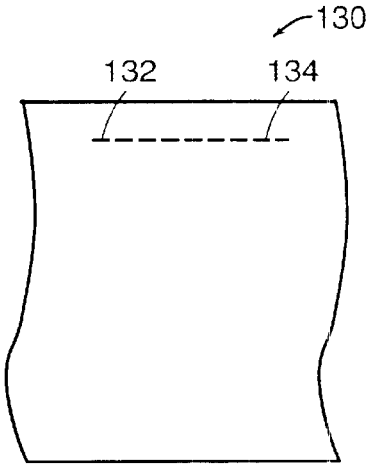
FIG. 28 is a somewhat diagrammatic plan view of a segment of a weft knit electric heating/warming article of another embodiment of the invention.

Alternatively, referring to FIG. 28, in a fibrous weft or circular knit heating/warming fabric article 130 of another embodiment of the invention, the stitch yarns, including the conductive yarns 132, may include elastic yarn or fibers 134, e.g. such as spandex, e.g., with a core of elastic synthetic resin material wound with fibers of cotton, bare spandex, a spandex and yarn combination, or other suitable material, to provide a degree of elasticity or stretch. Fibrous electric heating/warming fabric articles 130 of this embodiment of the invention may have particular application for use in heating pads (where medically indicated) that can fit more closely upon irregular surfaces of a body part to be heated or warmed. The conductor element or bus may also include elastic yarn or fibers.

Referring to FIG. 29, the substrate 162 upon which the heating/warming circuit 160 is mounted or formed may be an open grid fabric, e.g., scrim, or a moisture resistant, vapor permeable and/or wind resistant barrier material. Referring to FIG. 30, the heating/warming circuit 170 may be incorporated between the fabric layers 152, 154 of a fibrous double knit fabric article 150, with the layers 152, 154 joined, in face-to-face relationship, by interconnecting yarns.

Fibrous heating/warming devices of the invention may also be employed for delivering therapeutic heat to a selected region of the human body. For example, for delivering therapeutic heat upon a relatively large surface region, e.g., of the back or thigh, the heating/warming device may be in the form of a wrap or sleeve, with the heating/warning circuit having the form of a parallel circuit. For delivery of heating/warming to a more local region, a heating/warming device consisting of woven layers may be in a form suitable for mounting to strap or a brace with a heating/warming circuit having the form of a series circuit.

Accordingly, other embodiments are within the following claims.

What is claimed is:

1. A fibrous article adapted to generate heat upon application of electrical power, comprising:

a fibrous body comprised of non-conductive fibers, a plurality of spaced apart electrical resistance heating elements in the form of conductive elements joined in said fibrous body with the non-conductive fibers and extending generally between opposite edge regions of said fibrous body, and electrical conductor elements extending generally along said opposite edge regions of said fibrous body and adapted to connect said plurality of spaced apart electrical resistance heating elements in a parallel electrical circuit to a source of electrical power, said fibrous body having a technical face and a technical back, with fleece on at least one of said technical face and said technical back formed by finishing non-conductive fibers of said at least one of said technical face and said technical back in a manner to avoid damage to electrical conductivity performance of the conductive elements joined with the non-conductive fibers in said fibrous body.

2. The fibrous article of claim 1, wherein said electrical conductor elements are adapted for connecting said plurality of spaced-apart electrical resistance heating elements in the parallel electrical circuit to a power source of alternating current.

3. The fibrous article of claim 1, wherein said electrical conductor elements are adapted for connecting said plurality of spaced-apart electrical resistance heating elements in the parallel electrical circuit to a power source of direct current.

4. The fibrous article of claim 3, wherein said power source of direct current comprises a battery.

5. The fibrous article of claim 4, wherein said battery is mounted to said fibrous body.

6. The fibrous article of claim 1, wherein said fibrous article further comprises a power source connected to said plurality of spaced apart electrical resistance heating elements by said electrical conductor elements, said power source comprising a battery mounted to said fibrous body.

7. The fibrous article of claim 1, wherein a series of at least three electrical resistance heating elements of said plurality of electrical resistance heating elements are symmetrically spaced.

8. The fibrous article of claim 7, wherein a series of at least three electrical resistance heating elements of said plurality of electrical resistance heating elements are asymmetrically spaced.

9. The fibrous article of claim 1, wherein a series of at least three electrical resistance heating elements of said plurality of electrical resistance heating elements are asymmetrically spaced.

10. The fibrous article of claim 1, wherein said fibrous body comprises a body formed by knitting.

11. The fibrous article of claim 10, wherein said fibrous body formed by knitting comprises a reverse plaited circular knitted body.

12. The fibrous article of claim 10, wherein said fibrous body formed by knitting comprises a double knit body consisting of two, separate fibrous sheets joined by interconnecting fibrous elements.

13. The fibrous article of claim 1, wherein said fibrous body comprises a body formed by weaving.

14. The fibrous article of claim 1, wherein said fibrous body comprises a body formed by tufting or needling.

15. The fibrous article of claim 1, wherein said fibrous body comprises a body formed by felting.

16. The fibrous article of claim 1, wherein said fibrous body comprises a body formed by laying up of a non-woven fibrous web.

17. The fibrous article of claim 1, wherein said fibrous body comprises hydrophilic material.

18. The fibrous article of claim 1, wherein said fibrous body comprises hydrophobic material.

19. The fibrous article of claim 1, wherein said technical face is formed of a stitch yarn and said technical back is formed of a loop yarn.

20. The fibrous article of claim 19, wherein said loop yarn forms loops that overlay the stitch yarn at the technical face and forms loops at the technical back of the fibrous body.

21. The fibrous article of claim 19, wherein said fibrous body has loops formed only in a center region.

22. The fibrous article of claim 19, wherein said fibrous body has fleece formed in non-conductive fibers upon both of said technical back and said technical face.

23. The fibrous article of claim 19, wherein said conductive elements have the form of a conductive yarn.

24. The fibrous article of claim 23, wherein said conductive yarn is a stitch yarn.

25. The fibrous article of claim 1, wherein said electrical conductor elements, at least in part, are applied as a conductive paste.

26. The fibrous article of claim 25, wherein said electrical conductor elements comprise a conductive wire.

27. The fibrous article of claim 1, wherein said electrical conductor elements, at least in part, are applied as a conductive hot melt adhesive.

28. The fibrous article of claim 1, wherein said conductive elements comprise a core of insulating material, an electrical resistance heating filament disposed generally about said core, and a sheath material generally surrounding said electrical resistance heating filament and said core.

29. The fibrous article of claim 28, wherein said core comprises synthetic material.

30. The fibrous article of claim 29, wherein said synthetic material is polyester.

31. The fibrous article of claim 28, wherein said electrical resistance heating filament comprises at least one metal filament wrapped helically about said core.

32. The fibrous article of claim 31, wherein said electrical resistance heating filament comprises at least three metal filaments wrapped helically about said core.

33. The fibrous article of claim 31, wherein said at least one metal filament of said electrical resistance heating element is formed of stainless steel.

34. The fibrous article of claim 28, wherein said electrical resistance heating element has electrical resistance in the range of about 0.1 ohm/cm to about 500 ohm/cm.

35. The fibrous article of claim 28, wherein said fibrous sheath material comprises yarn wrapped about said electrical resistance heating filament and said core.

36. The fibrous article of claim 35, wherein said sheath material comprises synthetic material.

37. The fibrous article of claim 36, wherein said synthetic material is polyester.

38. The fibrous article of claim 1, wherein said conductive element comprises an electrical resistance heating filament and a fibrous sheath material generally surrounding said electrical resistance heating filament.

39. The fibrous article of claim 38, wherein said electrical resistance heating filament comprises at least one metal filament.

40. The fibrous article of claim 39, wherein said electrical resistance heating filament comprises at least three metal filaments.

41. The fibrous article of claim 39, wherein said at least one metal filament of said electrical resistance heating element is formed of stainless steel.

42. The fibrous article of claim 38, wherein said electrical resistance heating element has electrical resistance in the range of about 0.1 ohm/cm to about 500 ohm/cm.

43. The fibrous article of claim 38, wherein said sheath material comprises yarn wrapped about said electrical resistance heating filament.

44. The fibrous article of claim 43, wherein said sheath material comprises a yarn of synthetic material.

45. The fibrous article of claim 44, wherein said synthetic material is polyester.

46. The fibrous article of claim 1, wherein said conductive element comprises a core of insulating material and an electrical resistance heating filament disposed generally about said core.

47. The fibrous article of claim 46, wherein said core comprises synthetic material.

48. The fibrous article of claim 47, wherein said synthetic material is polyester.

49. The fibrous article of claim 46, wherein said electrical resistance heating filament comprises at least one metal filament.

50. The fibrous article of claim 49, wherein said electrical resistance heating filament comprises at least three metal filaments.

51. The fibrous article of claim 49, wherein said at least one metal filament of said electrical resistance heating element is formed of stainless steel.

52. The fibrous article of claim 46, wherein said electrical resistance heating element has electrical resistance in the range of about 0.1 ohm/cm to about 500 ohm/cm.

53. The fibrous article of claim 1, wherein said electrical resistance heating element has the form of a conductive element comprising an electrical resistance heating filament.

54. The fibrous article of claim 53, wherein said electrical resistance heating filament comprises at least one metal filament.

55. The fibrous article of claim 53, wherein said electrical resistance heating filament comprises at least three metal filaments.

56. The fibrous article of claim 54, wherein said at least one metal filament of said electrical resistance heating element is formed of stainless steel.

57. The fibrous article of claim 54, wherein said electrical resistance heating element has electrical resistance in the range of about 0.1 ohm/cm to about 500 ohm/cm.

58. A fibrous article adapted to generate heat upon application of electrical power, comprising:

a fibrous body comprised of non-conductive fibers, a plurality of spaced apart electrical resistance heating/warming elements in the form of conductive elements joined in said fibrous body together with the non-conductive fibers and extending generally between opposite edge regions of said fibrous body, and electrical conductor elements extending generally along said opposite edge regions of said fibrous body and adapted to connect said plurality of spaced apart electrical resistance heating/warming elements in a parallel electrical circuit to a source of electrical power, said fibrous body having a face and a back, with fleece on at least one of said face and said back formed by finishing non-conductive fibers of said at least one of said face and said back in a manner to avoid damage to electrical conductivity performance of the conductive elements joined with the non-conductive fibers in said fibrous body, and said fibrous body comprising a first fibrous layer and a second fibrous layer, and said plurality of spaced apart electrical resistance heating/warming elements of said fibrous body being disposed generally between said first fibrous layer and said second fibrous layer.

59. The fibrous article of claim 58, wherein said fibrous body comprises a double knit fibrous body and said first fibrous layer and said second fibrous layer are joined, in face-to-face relationship, by interconnecting fibrous elements, said plurality of spaced apart electrical resistance heating/warming elements of said fibrous body being positioned and spaced apart by said interconnecting fibrous elements and joined by said conductors in a parallel circuit.

60. The fibrous article of claim 58, wherein said first fibrous layer and said second fibrous layer are formed separately and joined in face-to-face relationship with said plurality of spaced apart electrical resistance heating/warming elements of said fibrous body disposed therebetween.

61. The fibrous article of claim 60, wherein said first fibrous layer and said second fibrous layer are joined by laminating.

62. The fibrous article of claim 60, wherein said first fibrous layer and said second fibrous layer are joined by stitching.

63. The fibrous article of claim 58, wherein said first fibrous layer and said second fibrous layer are formed separately and joined in face-to-face relationship with said plurality of spaced apart electrical resistance heating/warming elements of said fibrous body disposed therebetween, said plurality of spaced apart electrical resistance heating/warming elements are mounted upon a substrate, and said substrate with said plurality of spaced apart electrical resistance heating/warming elements mounted thereupon is disposed between said first fibrous layer and said second fibrous layer.

64. The fibrous article of claim 63, wherein said first fibrous layer and said second fibrous layer are joined by laminating.

65. The fibrous article of claim 63, wherein said first fibrous layer and said second fibrous layer are joined by stitching.

66. The fibrous article of claim 63, wherein said substrate comprises an open grid.

67. The fibrous article of claim 63, wherein said substrate comprises a moisture resistant, vapor permeable barrier material.

68. The fibrous article of claim 58, wherein said first fibrous layer and said second fibrous layer are formed separately and joined in face-to-face relationship with said plurality of spaced apart electrical resistance heating/warming elements of said fibrous body disposed therebetween, and said plurality of spaced apart electrical resistance heating/warming elements are mounted upon at least one opposed surface of said first fibrous layer and said second fibrous layer.

69. The fibrous article of claim 68, wherein said first fibrous layer and said second fibrous layer are joined by laminating.

70. The fibrous article of claim 68, wherein said first fibrous layer and said second fibrous layer are joined by stitching.

71. A fibrous article adapted to generate heat upon application of electrical power, formed by a method comprising the steps of:

joining a stitch yarn and a loop yarn to form a fibrous prebody, with the loop yarn overlaying the stitch yarn at a technical face and forming in loops at a technical back of the fibrous prebody, at spaced-apart intervals, incorporating into the fibrous prebody as the stitch yarn an electrical resistance heating/warming element in the form of a conductive yarn, forming the fibrous prebody into a fibrous body, with the electrical resistance heating/warming elements extending between opposite edge regions of the fibrous body, in a manner to avoid damage to electrical conductivity performance of the electrical resistance heating/warming elements, finishing non-conductive fibers of at least one of said technical face and said technical back of the fibrous body to form a fleece surface region, and providing conductive elements for connecting the electrical resistance heating/warming elements, in parallel, to a source of electrical power.

72. The method of forming the fibrous article of claim 71, said method further comprising the step of joining the fibrous stitch yarn and the fibrous loop yarn by a reverse plaiting circular knitting process.

73. The method of forming the fibrous article of claim 71 or claim 72, said method further comprising the steps of:

finishing non-conductive fibers of the technical face of the fibrous body, in a manner to avoid damage to electrical conductivity performance of the electrical resistance heating/warming elements, to form a first fleece surface region, and finishing non-conductive fibers of the technical back of the fibrous body in a manner to avoid damage to electrical conductivity performance of the electrical resistance heating/warming elements to form a second fleece surface region.

74. A method of forming a fibrous article adapted to generate heat upon application of electrical power, said method comprising the steps of:

joining a stitch yarn and a loop yarn to form a fibrous prebody, the stitch yarn forming a technical face of the fibrous prebody and the loop yarn forming a technical back of the fibrous prebody, the loop yarn forming in loops that overlay the stitch yarn at the technical face and at the technical back of the fibrous prebody, at spaced-apart intervals, incorporating into the fibrous prebody as the stitch yarn an electrical resistance heating element in the form of a conductive yarn, forming the fibrous prebody into a fibrous body, with the electrical resistance heating elements extending between opposite edge regions of the fibrous body, in a manner to avoid damage to electrical conductivity of the electrical resistance heating elements, finishing non-conductive fibers of at least one of said technical face and said technical back of the fibrous body to form a fleece surface region, and providing conductive elements for connecting the electrical resistance heating elements, in parallel, to a source of electrical power.

75. The method of claim 74, further comprising the step of joining the stitch yarn and the loop yarn by a reverse plaiting circular knitting process.

76. The method of claim 74 or claim 75, further comprising the steps of:

finishing non-conductive fibers of the technical face of the fibrous body, in a manner to avoid damage to electrical conductivity of the electrical resistance heating elements, to form a first fleece surface region, and finishing non-conductive fibers of the technical back of the fibrous body in a manner to avoid damage to electrical conductivity of the electrical resistance heating elements to form a second fleece surface region.

77. The method of claim 74, wherein the conductive yarn of the fibrous prebody comprises a core of insulating material, an electrical resistance heating filament disposed generally about said core, and a sheath material generally surrounding said electrical resistance heating element and said core.

78. The method of claim 77 further comprising the step of forming the sheath material by wrapping said electrical resistance heating element and said core with fibrous material.

79. The method of claim 74 further comprising the step of connecting the conductive element to a source of electric power and generating heat.

80. The method of claim 79 further comprising the step of connecting the conductive element to a source of electric power comprising alternating current and generating heat.

81. The method of claim 79 further comprising the step of connecting the conductive element to a source of electric power comprising direct current and generating heat.

82. The method of claim 81 further comprising the step of connecting the conductive element to a source of electric power comprising direct current in the form of a battery and generating heat.

83. The method of claim 82 further comprising the step of connecting the conductive element to a source of electric power comprising direct current in the form of a battery mounted to the fibrous article and generating heat.

84. The method of claim 74 further comprising the steps of:

limiting formation of loops to a central region of the fibrous prebody, the central region being spaced from edge regions in the fibrous body, and providing the conductive elements for connecting the electrical resistance heating elements to a source of electrical power in the edge regions of the fibrous body.

85. The method of claim 74 further comprising the step of rendering elements of said fibrous body hydrophilic.

86. The method of claim 74 further comprising the step of rendering elements of said fibrous body hydrophobic.

* * * * *